US006319092B1

(12) United States Patent
Leyhe et al.

(10) Patent No.: US 6,319,092 B1
(45) Date of Patent: Nov. 20, 2001

(54) NURSING BRA WITH REMOVABLE/ REPLACEABLE CUPS

(76) Inventors: Polly A. Leyhe, 826 Atwood St., Longmont, CO (US) 80501; Kristy D. Warner, 3357 Larkspur Dr., Longmont, CO (US) 80503

( * ) Notice: Subject to any disclaimer, the term of this patent is extended or adjusted under 35 U.S.C. 154(b) by 0 days.

(21) Appl. No.: 09/670,638

(22) Filed: Sep. 27, 2000

(51) Int. Cl.[7] ..... A41C 3/00
(52) U.S. Cl. ..... 450/36; 450/37
(58) Field of Search ..... 450/36, 37, 54, 450/55, 57, 56

(56) References Cited

U.S. PATENT DOCUMENTS

| | | | | |
|---|---|---|---|---|
| 2,748,771 | * | 6/1956 | Richards | 450/36 |
| 2,767,402 | * | 10/1956 | Pauk | 450/36 |
| 2,891,544 | * | 6/1959 | London | 450/36 |
| 2,925,816 | * | 2/1960 | Rosenthal | 450/36 |
| 3,149,635 | * | 9/1964 | Garutso | 450/36 |
| 3,203,424 | * | 8/1965 | Garutso | 450/36 |
| 3,425,420 | * | 2/1969 | Steinberger | 450/36 |
| 5,269,720 | * | 12/1993 | Moretz et al. | 450/37 |

* cited by examiner

*Primary Examiner*—Gloria M. Hale
(74) *Attorney, Agent, or Firm*—Edwin H. Crabtree; Ramon L. Pizawo; Donald W. Margolis

(57) ABSTRACT

A nursing bra worn by a mother when nursing an infant. The nursing bra allows the mother to change out only a wet section of the bra without having to remove clothing and replace the entire bra. The nursing bra includes broadly a bra frame with shoulder straps and adjustable back straps for holding the bra on the mother. The bra frame includes a first bra cup frame member with a first opening therethrough and a second bra cup frame member with a second opening therethrough. The first and second bra cup frame members include hook and loop fasteners or other types of fasteners for releasably securing a removable first bra cup and a removable second bra cup. The first and second bra cups are made of an absorbent material for absorbing mother's milk that leaks from the mother's breast when wearing the nursing bra. Also, the first and second bra cups come in different cup sizes for different size breasts. When the first or second bra cup becomes moist or wet with leaking milk from the mother's breast, the cup can be quickly removed from the bra cup frame members and replaced with a replaceable clean and fresh bra cup. Each of the bra cups are washable and interchangeable with each other for ongoing use with the first and second bra cup frame members during the nursing of the child.

18 Claims, 2 Drawing Sheets

NURSING BRA WITH REMOVABLE/ REPLACEABLE CUPS

BACKGROUND OF THE INVENTION (a) Field of the Invention

This invention relates to a women's brassiere and more particularly, but not by way of limitation, to a nursing bra with removable, replaceable and washable cup members used when a mother is nursing a new born child.

(b) Discussion of Prior Art

Heretofore, there have been a variety of different types of nursing bras. For example, in U.S. Pat. No. 3,513,852 to Seidl a removable cup member is disclosed but the cup member is used to protect a mother's breast when bumped or holding a baby and is designed to hold a separate absorbent pad therein. Also, in U.S. Pat. No. 2,856,935 to Croxall, U.S. Pat. No. 4,355,641 to Dastoli et al., U.S. Pat. No. 4,633,876 to Scullin and U.S. Pat. No. 4,911,677 to White different types of nursing bras are illustrated. All of these patents disclose the folding of a portion of a bra cup for access to a mother's breast when nursing a baby. The patents do not disclose the use of removable and replaceable bra cups attached to bra cup frame members.

None of the above mentioned patents provide the unique combination of structure, function, objects and advantages of the subject nursing bra having removable and replaceable bra cups releasably attached to a bra frame.

SUMMARY OF THE INVENTION

In view of the foregoing, it is a primary object of the present invention to provide a nursing bra which allows the mother to change out only a wet bra cup of the bra without having to remove clothing and replace the entire bra.

Another object of the invention is the nursing bra includes a plurality of removable, replaceable and interchangeable bra cups which can be carried, for example, in a diaper bag, and changed periodically when one or both of the bra cups become moist from leaking milk from the mother's breast.

Still another object of the nursing bra is each bra cup is made of an absorbent material for quickly absorbing leaking mother's milk. Also, the bra cups are washable for ongoing use with the nursing bra.

Yet another object of the invention is the bra cups come in different cup sizes for different size breasts. Also, the bra frame and bra cups may have different types of fasteners for releasably securing the cups to the bra cup frame.

The nursing bra includes broadly a bra frame with shoulder straps and adjustable back straps for holding the bra on the mother. The bra frame includes a first bra cup frame member with a first frame member opening therethrough. The bra frame also includes a second bra cup frame member with a second frame member opening therethrough. The first and second bra cup frame members include hook and loop fasteners or other types of fasteners for releasably securing a removable first bra cup and a removable second bra cup. The first and second bra cups are made of an absorbent material for absorbing mother's milk that leaks from the mother's breast and are made in different sizes for conforming to the size of the mother's breast.

These and other objects of the present invention will become apparent to those familiar with different types of nursing bras from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
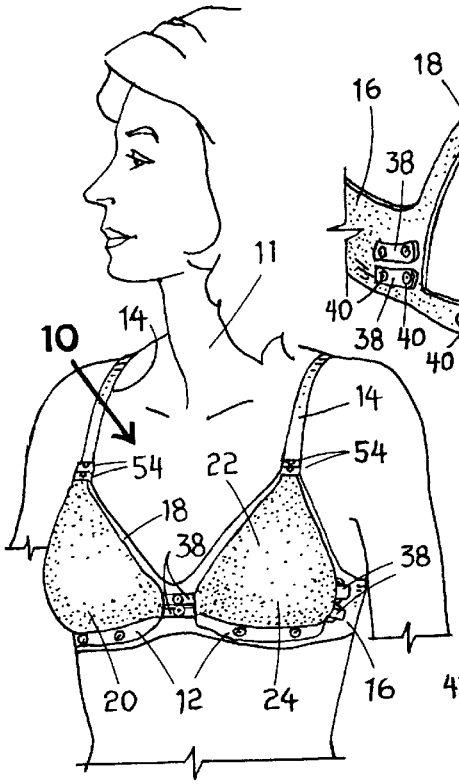
FIG. 1 is a perspective view of a female model wearing the subject invention. In this view, the nursing bra is shown with a bra frame, shoulder straps and back straps. The straps are secured to the back of the model. The bra frame is shown with removable first and second bra cups releasably attached to sides of first and second bra cup frame members.

In FIG. 1, a perspective view of the subject nursing bra, having general reference numeral 10, is shown being worn by a female model 11. In this view, the nursing bra 10 is illustrated broadly with a bra frame 12, shoulder straps 14 and back straps 16. The straps 14 and 16 are secured together at the back of the model 11. The back of the model 11 is not shown in the drawings.

The bra frame 12 includes a first bra cup frame member 18 having a first bra cup 20 removably attached thereto. Also, the frame 12 includes a second bra cup frame 22 having a second bra cup 24 removably attached thereto.

It should be noted that the first and second bra cups 20 and 24 may be interchangeable with each other for ease in manufacturing and attachment to either the first or second frame members 18 and 22. Also, the cups 20 and 24 are made of a soft absorbent material, such as cotton or cotton blend, for quickly absorbing leaking milk from the mother's breast. Further, the cups can be made in various cup sizes for conforming to the size of the mother's breast. Still further, while the cups 20 and 24 are shown triangular in shape, they may have various geometric shapes without departing from the spirit and scope of the invention.

Figure 2:
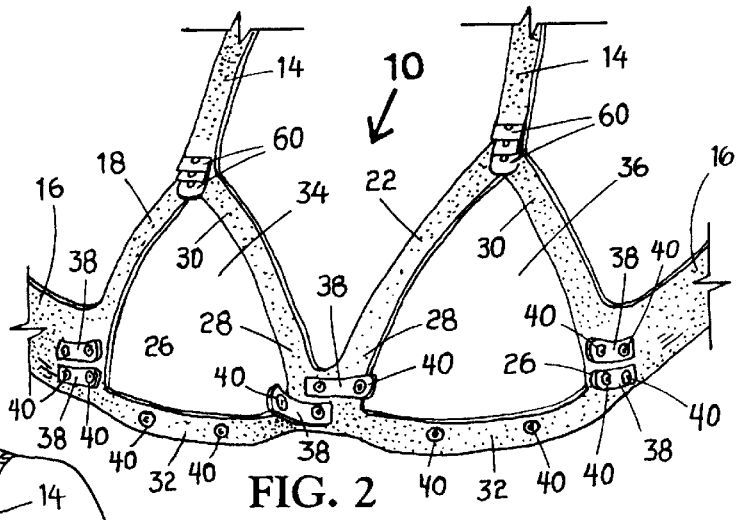
FIG. 2 is a front view of the bra frame shown in FIG. 1 but with the first and second bra cups removed from the sides of the first and second bra cup frame members.

In FIG. 2, a front view of the bra frame 12 is shown. In this drawing, the first and second bra cups 20 and 24 have been removed from the sides of the first and second bra cup frame members 18 and 22. The first and second bra cup frame members 18 and 22 include a first side 26, a second side 28, a top portion 30 and a bottom portion 32. Also, the first bra cup frame member 18 is shown with a first frame opening 34. Likewise, the second bra cup frame member 22 is shown with a second frame opening 36. The first and second frame openings 34 and 36 are sized to receive the mother's breast therethrough with the frame members 18 and 20 disposed comfortably around the sides of the breasts.

The first and second bra cups 20 and 24 are attached to the bra frame 12 in this example using a pair of fabric tags 38 with metal or plastic snaps 40 on opposite ends of the tags 38. A pair of tags 38 are attached to the first side 26 of the first and second frame members 18 and 22. Also, a pair of tags 38 are attached between the second sides 28 of the first and second frame members 18 and 22. The tags 38 are used for receipt through fabric loops 42 attached to sides of the bra cups 20 and 24. The fabric loops 42 are shown in FIGS. 2A and 2B.

Figure 2A:
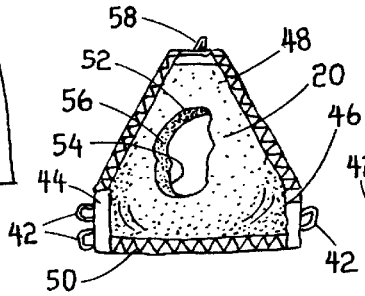
FIG. 2A is a front view of a first bra cup with loop fasteners on the sides of the cup.

In FIG. 2A, a front view of the first bra cup 20 is shown with the fabric loops 42 disposed on a first side 44 and a second side 46 of the bra cup 20. Also, the bra cup 20 includes a top portion 48 and a bottom portion 50. The sides of the bra cups 20 and 24 are stitched and may include a lace trim therearound for added appearance. While the first bra cup 20 is discussed in detail in the drawings, it should be mentioned that the second bra cup 24, as shown in FIG. 1, is identical in structure and function when compared to the first bra cup 20. Also shown in this drawing is a portion of the bra cup 20 cut away to illustrate an outer liner 52, an inner liner 54 and absorbent padding 56 therebetween. obviously, by providing the bra cup 20 with additional padding 56 the ability of the cup to absorb moisture is enhanced. While the additional padding 56 is shown in FIG. 2A, it can be appreciated that the bra cups 20 and 24 need not have any padding over and above the absorbent material making up the fabric used in the two cups.

Figure 2B:
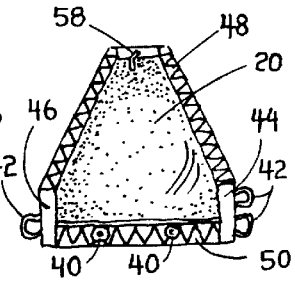
FIG. 2B is a rear view of the first bra cup shown in FIG. 2A and illustrating a hook fastener in a top portion of the bra cup, a pair of snap fasteners in a bottom portion of the cup and fabric loops in the sides of the cup for securing the bra cup to the sides of the first bra cup frame member.

In FIG. 2B, a rear view of the first bra cup 20 is shown and illustrating a metal or plastic hook 58 in the top portion of the cup. The hook 58 is designed for releasable attachment to metal or plastic loops 60 in the top portion 30 of the first and second frame members 18 and 20 as shown in FIG. 2. In FIG. 2, a series of the loops 60 are shown one on top of the other for providing for a comfortable adjustment of the cups 20 and 24 when secured to the bra frame 12.

Also shown in this drawing are a pair of the snaps 40 in the bottom portion 50 of the first bra cup 20. The snaps 40 are used for releasable attachment to the snaps 40 shown in the bottom portion 32 of the first and second frame members 18 and 20 shown in FIG. 2.

Figure 3:
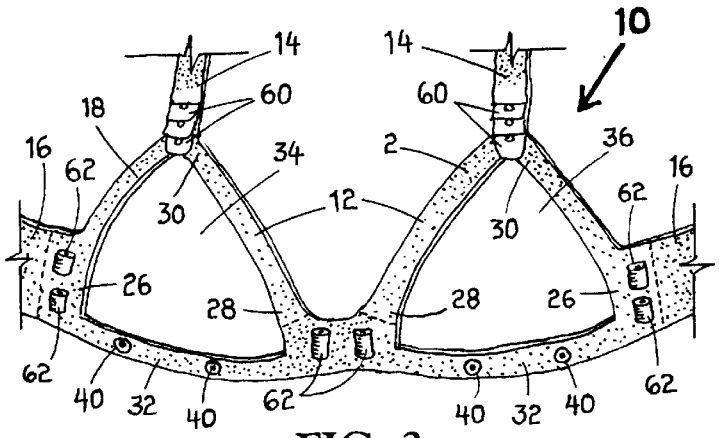
FIG. 3 is a front view of another embodiment of the subject nursing bra with the bra frame having hook insert collars and snaps in the sides and a bottom portion of the first and second bra cup frame members.

In FIG. 3, a front view of another embodiment of the subject nursing bra 10 is illustrated. In this view, the bra frame 12 includes a plurality of hook insert collars 62 in the sides 26 and 28 of the first and second bra cup frame members 18 and 22. The hook insert collars 62 are adapted for releasably receiving hooks 58 attached to the first and second sides 44 and 46 of the bra cups 20 and 24. This is another way of attaching the cups to the bra frame 12.

Figure 3A:
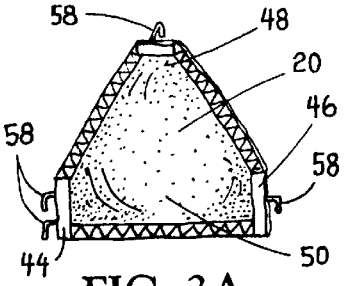
FIG. 3A is a front view of the first bra cup with hook fasteners on the sides of the cup.

In FIG. 3A, a front view of the first bra cup 20 is shown. In this drawing, the hooks 58 are shown attached to sides 44 and 46 of the cup 20.

Figure 3B:
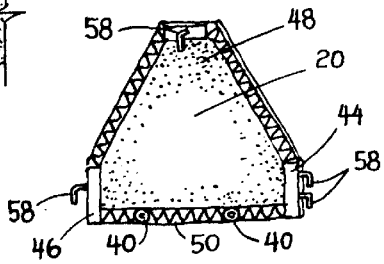
FIG. 3B is a rear view of the first bra cup shown in FIG. 3A and illustrating the hook fastener on the sides and on the top portion of the bra cup and snap fasteners in the bottom portion of the cup for securing the bra cup to the sides of the first bra cup frame member.

In FIG. 3B, a rear view of the first bra cup 20 is illustrated. The hooks 58 are attached to the sides 44 and 46 and on the top portion 50 of the bra cup 20. Also, snaps 40 are shown attached to the bottom portion 50 for releasably attaching the bra cup 20 to the snaps 40 in the bottom portion 32 of the first cup frame member 18. As mentioned above, while not shown in the drawings, the second bra cup 24 has similar hooks and snaps for securing the cup to the second cup frame member 22.

Figure 4:
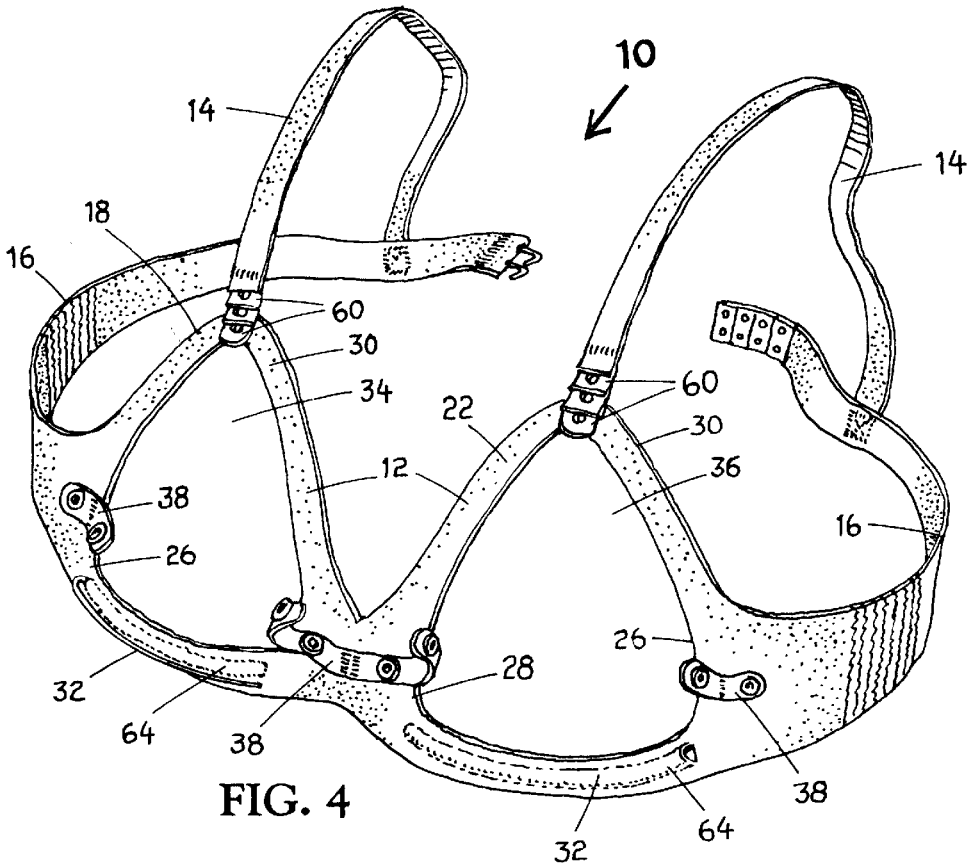
FIG. 4 is a front view of still another embodiment of the subject nursing bra with the bra frame having an underwire collar in the bottom portion of the first and second bra cup frame members for receiving an underwire attached to the bottom portion of the first and second bra cups.

In FIG. 4, a front view of still another embodiment of the subject nursing bra 10 is shown. In this drawing, an underwire collar 64 is attached in the bottom 32 of the first and second bra cup frame members 18 and 22. The underwire collars 64 are adapted for receiving a portion of an underwire 66 attached to the bottom portion 50 of the first and second bra cups 20 and 24.

Figure 4A:
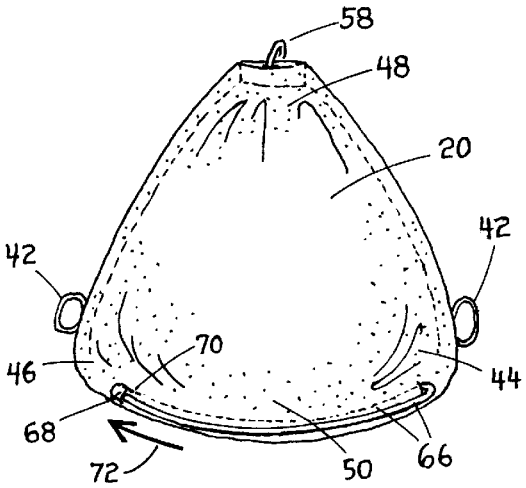
FIG. 4A is a front view of the first bra cup with a double underwire attached to the bottom portion of the first bra cup.

In FIG. 4A, a front view of the first bra cup 20 is shown with the underwire 66 folded to form a double wire with the upper portion of the underwire 66 held in place in the bottom portion 50 of the cup 20. A lower portion of the underwire 66 is used for releasably inserting into the underwire collar 64 shown in FIG. 4.

Figure 4B:
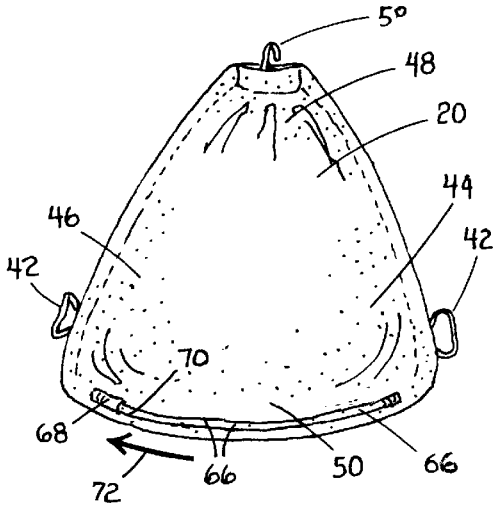
FIG. 4B is another front view of the first bra cup with a single underwire attached to the bottom portion of the first bra cup.

In FIG. 4B, another front view of the first bra cup 20 is illustrated with a single underwire 66 attached to the bottom portion 50 of the first bra cup 20. It should be noted that the bottom portion 50 of the first bra cup 20 includes an underwire sleeve 68 for receiving an end 70 of the underwire 66, as indicated by arrow 72, when the underwire has been completely inserted through the underwire collar 64 in the bottom portion 32 of the cup frame members 18 and 22. The sleeve 68 is designed to protect the user of the nursing bra 10 from the end 70 of the underwire 66 poking into her chest when wearing the bra 10.

While the first and second bra cups 18 and 22 have been discussed having different types of releasable fasteners for securing the cups to the bra frame 12, it should be kept in mind various types of fasteners such as hook and loop fasteners having a brand name "VELCRO", zippers and similar types of fasteners can be used equally well without departing from the scope of the invention as described above.

When the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A nursing bra worn by a mother when nursing an infant, the nursing bra allows the mother to change out only a wet section of the bra without having to remove clothing and replace the entire bra, the nursing bra comprising:

a bra frame, said bra frame having a first bra cup frame member with a first frame opening therethrough and a second bra cup frame member with a second frame opening therethrough;

a first bra cup releasably attached to said first bra cup frame member;

a second bra cup releasably attached to said second bra cup frame member; and an underwire attached to a bottom portion of said first and second bra cups, said underwire adapted for slidable receipt in an underwire collar in a bottom portion of said first and second bra cup frame members.

2. The nursing bra as described in claim 1 wherein said bra frame includes shoulder straps and adjustable back straps adapted for holding said bra frame on the mother.

3. The nursing bra as described in claim 1 wherein said first and second bra cups are made of an absorbent material adapted for absorbing mother's milk that leaks from the mother's breast when wearing the nursing bra.

4. The nursing bra as described in claim 1 wherein said first and second bra cups include an outer liner, an inner liner and adsorbent padding therebetween.

5. The nursing bra as described in claim 1 wherein said first and second bra cups come in different cup sizes for different size breasts.

6. The nursing bra as described in claim 1 wherein said first and second bra cups are made in different geometric shapes for releasable attachment to said first and second bra cup frame members.

7. The nursing bra as described in claim 1 wherein said first and second bra cups are interchangeable with each other for releasable attachment to said first and second bra cup frame members.

8. A nursing bra worn by a mother when nursing an infant, the nursing bra allows the mother to change out only a wet section of the bra without having to remove clothing and replace the entire bra, the nursing bra comprising:

a bra frame with shoulder straps and adjustable back straps adapted for holding said bra frame on the mother, said bra frame having a first bra cup frame member with a first frame opening therethrough and a second bra cup frame member with a second frame opening therethrough;

a first bra cup having an underwire, a first portion of said underwire attached to a bottom portion of said first bra cup, a second portion of said underwire adapted for slidable receipt in an underwire collar in a bottom portion of said first bra cup frame member; and a second bra cup having an underwire, a first portion of said underwire attached to a bottom portion of said second bra cup, a second portion of said underwire adapted for slidable receipt in an underwire collar in a bottom portion of said second bra cup frame member.

9. The nursing bra as described in claim 8 wherein said first and second bra cups are made of an absorbent material adapted for absorbing mother's milk that leaks from the mother's breast when wearing the nursing bra.

10. The nursing bra as described in claim 8 wherein said first and second bra cups include an outer liner, an inner liner and adsorbent padding therebetween.

11. The nursing bra as described in claim 8 wherein said first and second bra cups come in different cup sizes for different size breasts.

12. The nursing bra as described in claim 8 wherein said first and second bra cups are made in different geometric shapes for releasable attachment to said first and second bra cup frame members.

13. The nursing bra as described in claim 8 wherein said first and second bra cups are interchangeable with each other for releasable attachment to said first and second bra cup frame members.

14. A nursing bra worn by a mother when nursing an infant, the nursing bra allows the mother to change out only a wet section of the bra without having to remove clothing and replace the entire bra, the nursing bra comprising:

a bra frame with shoulder straps and adjustable back straps adapted for holding said bra frame on the mother, said bra frame having a first bra cup frame member with a first and second side, a top portion, a bottom portion and a first frame opening therethrough and a second bra cup frame member with a first and second side, a top portion, a bottom portion and a second frame opening therethrough;

a first bra cup having first releasable fastener means mounted on the first side, a second side, a top portion and a bottom portion for securing said first bra cup to the sides, top portion and bottom portion of said first bra cup frame member; and a second bra cup having second releasable fastener means mounted on the first side, a second side, a top portion and a bottom portion for securing said second bra cup to the sides, top portion and bottom portion of said second bra cup frame member, said first bra cup and said second bra cup having different cup sizes for different size breasts.

15. The nursing bra as described in claim 14 wherein said first and second bra cups are made of an absorbent material adapted for absorbing mother's milk that leaks from the mother's breast when wearing the nursing bra.

16. The nursing bra as described in claim 14 wherein said first and second bra cups include an outer liner, an inner liner and adsorbent padding therebetween.

17. The nursing bra as described in claim 14 wherein said first and second bra cups are made in different geometric shapes for releasable attachment to said first and second bra cup frame members.

18. The nursing bra as described in claim 14 wherein said first and second bra cups are interchangeable with each other for releasable attachment to said first and second bra cup frame members.

* * * * *